US006321782B1

(12) United States Patent
Hollister

(10) Patent No.: US 6,321,782 B1
(45) Date of Patent: Nov. 27, 2001

(54) APPARATUS FOR CONTROLLING THE FLOW OF FLUIDS

(76) Inventor: Ronald Hollister, 6A Hobson St., Danbury, CT (US) 06810

( * ) Notice: Subject to any disclaimer, the term of this patent is extended or adjusted under 35 U.S.C. 154(b) by 0 days.

(21) Appl. No.: 09/514,722

(22) Filed: Feb. 28, 2000

Related U.S. Application Data

(63) Continuation-in-part of application No. 09/004,120, filed on Jan. 7, 1998, now Pat. No. 6,047,729.

(60) Provisional application No. 60/122,321, filed on Mar. 1, 1999, and provisional application No. 60/035,225, filed on Jan. 8, 1997.

(51) Int. Cl.[7] ..... F17C 5/00

(52) U.S. Cl. ..... 137/557; 137/883

(58) Field of Search ..... 137/557, 883

(56) References Cited

U.S. PATENT DOCUMENTS

| | | | | |
|---|---|---|---|---|
| 144,565 | * | 11/1873 | Roos | 137/883 |
| 206,611 | | 7/1878 | Rainey . | |
| 572,580 | | 12/1896 | Spitzenberg . | |
| 667,188 | | 2/1901 | Clavez . | |
| 828,597 | | 8/1906 | Cowles . | |
| 1,099,713 | | 6/1914 | Morris . | |
| 1,230,007 | * | 12/1917 | Milliken | 137/883 |
| 1,385,609 | | 7/1921 | Durkee . | |
| 1,387,991 | | 8/1921 | Kunke et al. . | |
| 1,768,739 | | 7/1930 | Boyd . | |
| 1,957,972 | | 5/1934 | Mills | 59/23 |
| 2,418,808 | | 4/1947 | Benson | 299/77 |
| 2,762,387 | | 9/1956 | Orwin | 137/360 |
| 3,028,877 | | 4/1962 | Thieme | 137/509 |
| 3,143,137 | | 8/1964 | Muller | 137/552 |
| 3,270,768 | | 9/1966 | Kamowski | 137/327 |
| 3,361,160 | | 1/1968 | Alper | 137/557 |
| 3,472,276 | | 10/1969 | Grove | 137/552 |
| 3,633,618 | | 1/1972 | Blackmore | 137/597 |
| 3,853,144 | * | 12/1974 | Whelan | 137/883 |
| 3,911,947 | | 10/1975 | Boxall | 137/505.14 |
| 4,552,181 | | 11/1985 | Hawkins | 137/875 |
| 4,913,351 | | 4/1990 | Costa | 239/74 |
| 5,036,883 | | 8/1991 | McHugh | 137/559 |
| 5,056,563 | * | 10/1991 | Glossop | 137/883 |
| 5,269,344 | | 12/1993 | McHugh | 137/557 |
| 5,303,733 | * | 4/1994 | Nelson | 137/505.38 |
| 6,047,729 | * | 4/2000 | Hollister et al. | 137/557 |

FOREIGN PATENT DOCUMENTS

| | | |
|---|---|---|
| 277899 | 12/1951 | (CH) . |
| 2703091 | 7/1978 | (DE) . |
| 975869 | 10/1950 | (FR) . |
| 2231907 | 12/1974 | (FR) . |

OTHER PUBLICATIONS

An article from a publication entitled "Fire Essentials Manual", published by IFSTA Publication Date: Prior to 1996.

Pages 25, 38 and 39 of product catalog of Elkhart Brass Mfg. Co. showing model 227A gauges, B–95A, B–97A and B–100 Valved Wyes, and BG–104A Water Thief. Copyright: 1997.

* cited by examiner

*Primary Examiner*—A. Michael Chambers
(74) *Attorney, Agent, or Firm*—Raymond A. Nuzzo

(57) ABSTRACT

An apparatus for controlling the flow and measuring the pressure of fluids comprising at least one fluid inlet portion adapted for fluid connection to a fluid source, at least one fluid outlet portion fluidly connected to the fluid inlet portion, a first device for controlling the flow and measuring the pressure of fluid flowing into the fluid inlet portion, and a second device for controlling the flow and measuring the pressure of fluid flowing through the fluid outlet portion.

7 Claims, 5 Drawing Sheets

APPARATUS FOR CONTROLLING THE FLOW OF FLUIDS

This application claims the benefit of U.S. provisional application serial no. 60/122,321 filed Mar. 1, 1999 and 60/035,225 filed Jan. 8, 1997 and is a continuation-in-part application of commonly owned and U.S. application Ser. No. 09/004,120 filed Jan. 7, 1998. now U.S. Pat. No. 6,047,729 issued Apr. 1, 2000.

BACKGROUND OF THE INVENTION

1. Field Of The Invention

The present invention relates to an apparatus for controlling the flow and measuring the pressure of fluids.

2. Problem to be Solved

Typically, many commercial, industrial and public buildings have a plurality of water sources wherein each water source is located at a different location within the building. Such water sources provide water for use in suppressing fires. These water sources are typically configured as standpipes having a control valve and a fluid outlet adapted for fluid connection to a fire hose. During a fire, proper control of water pressure at each of these water sources is vital to the operation of all fire hoses used on a particular floor of a building, as well as the operation of fire hoses being used on other floors of the building. The failure to maintain proper flow control at each water source may have tragic consequences to life as well as property. Therefore, it is highly critical that fire fighting personnel be able to control the fluid flow at each standpipe when multiple fire hoses are utilized.

One conventional method of indicating the water pressure available at a particular water source is to color code the pressure reducing valves that are connected to the standpipes. For example, each color represents a particular water pressure. However, color coding of each pressure reducing valve does not accurately indicate the available water pressure at a typical standpipe at any given time. It is not possible for the aforementioned color-coding system to indicate sudden and drastic increases or decreases in water pressure.

Accordingly, it is an object of the present invention to provide an apparatus that can be fluidly connected to a fluid source to control the flow and measure the pressure of fluid at the fluid source.

It is another object of the present invention to provide an apparatus that can be fluidly connected to a fluid source to control the flow and measure the pressure of fluid at the fluid source wherein the apparatus is portable.

It is another object of the present invention to provide a portable apparatus that can be fluidly connected to a fluid source to control the flow and measure the pressure of fluid at the fluid source that is easy to use.

It is another object of the present invention to provide a portable apparatus that can be fluidly connected to a fluid source to control the flow and measure the pressure of fluid at the fluid source and which allows fire fighting personnel to have substantially total control in controlling the flow of fluid flowing from the fluid source.

It is a further object of the present invention to provide a portable apparatus that can be fluidly connected to a fluid source to control the flow and measure the pressure of fluid at the fluid source that is inexpensive to manufacture.

These and other objects of the present invention will become readily apparent upon further review of the following specification and drawing.

SUMMARY OF THE INVENTION

The above and other objects, which will be apparent to those skilled in the art. are achieved in the present invention which is directed to, in a first aspect, an apparatus for controlling the flow of fluids. The apparatus comprises at least one fluid inlet portion adapted for fluid connection to a fluid source, at least one fluid outlet portion fluidly connected to the fluid inlet portion, a first device for controlling the flow and measuring the pressure of fluid flowing into the fluid inlet portion, and a second device for controlling the flow and measuring the pressure of fluid flowing through the fluid outlet portion.

The fluid inlet portion has a first diameter and the fluid outlet portion has a second diameter. In one embodiment, the second diameter is less than the first diameter. In another embodiment, the second diameter is greater than the first diameter. In a further embodiment, the first and second diameters are equal.

In a preferred embodiment, the first device comprises a movable fluid flow regulator member located within the fluid inlet portion for regulating the flow of fluid therethrough. The flow of fluids through the fluid inlet portion is affected by the position of the movable fluid flow regulator member. The first device further comprises an adjustable member on the fluid inlet portion. The adjustable member has a first portion accessible from the exterior of the fluid inlet portion and a second portion located within the fluid inlet portion for positioning the movable regulator member so as to achieve a desired fluid flow. The first device further comprises a fluid pressure meter for indicating the pressure of the fluid flowing through the fluid inlet portion.

In a preferred embodiment, the second device comprises a movable fluid flow regulator member located within the fluid outlet portion for regulating the flow of fluid therethrough. The flow of fluids through the fluid outlet portion is affected by the position of the movable fluid flow regulator member. The second device further comprises an adjustable member on the fluid outlet portion. T he adjustable member has a first portion accessible from the exterior of the fluid outlet portion and a second portion located within the fluid outlet portion for positioning the movable regulator member so as to achieve a desired fluid flow. The first device further comprises a fluid pressure meter for indicating the pressure of the fluid flowing through the fluid outlet portion.

In a preferred embodiment, the fluid pressure meters respond linearly to changes in fluid flow conditions.

In another embodiment, the apparatus of the present invention comprises a fluid inlet portion adapted for fluid connection to a fluid source and first and second fluid outlet portions fluidly connected to the fluid inlet portion. The fluid inlet portion and first and second fluid outlet portions are arranged in a substantially "Y" shaped configuration. The apparatus further comprises a first device for controlling the flow and measuring the pressure of fluid flowing into the fluid inlet portion. The apparatus also comprises second and third devices for controlling the flow and measuring the pressure of fluid flowing through the first and second fluid outlet portions, respectively.

In yet a further embodiment, the present invention is directed to an apparatus for controlling the pressure of fluids comprising at least one fluid inlet portion adapted for fluid connection to a fluid source, at least one fluid outlet portion fluidly connected to the fluid inlet portion, a movable fluid flow regulator member located within the fluid outlet portion for regulating the flow of fluid therethrough wherein the flow of fluids through the fluid outlet portion is affected by the position of the movable fluid flow regulator member, and an adjustable member on the fluid output portion which has a first portion accessible from the exterior of the fluid outlet portion and a second portion located within the fluid outlet portion for positioning the movable regulator member so as to achieve a desired fluid flow.

BRIEF DESCRIPTION OF THE DRAWINGS

The features of the invention are believed to be novel and the elements characteristic of the invention are set forth with particularity in the appended claims. The figures are for illustration purposes only and is not drawn to scale. The invention itself, however. both as to organization and method of operation, may best be understood by reference to the detailed description which follows taken in conjunction with the accompanying drawing in which:

DETAILED DESCRIPTION OF THE INVENTION

In describing the preferred embodiments of the present invention, reference will be made herein to FIGS. 1–5 in which like numerals refer to like features of the invention.

Figure 1:
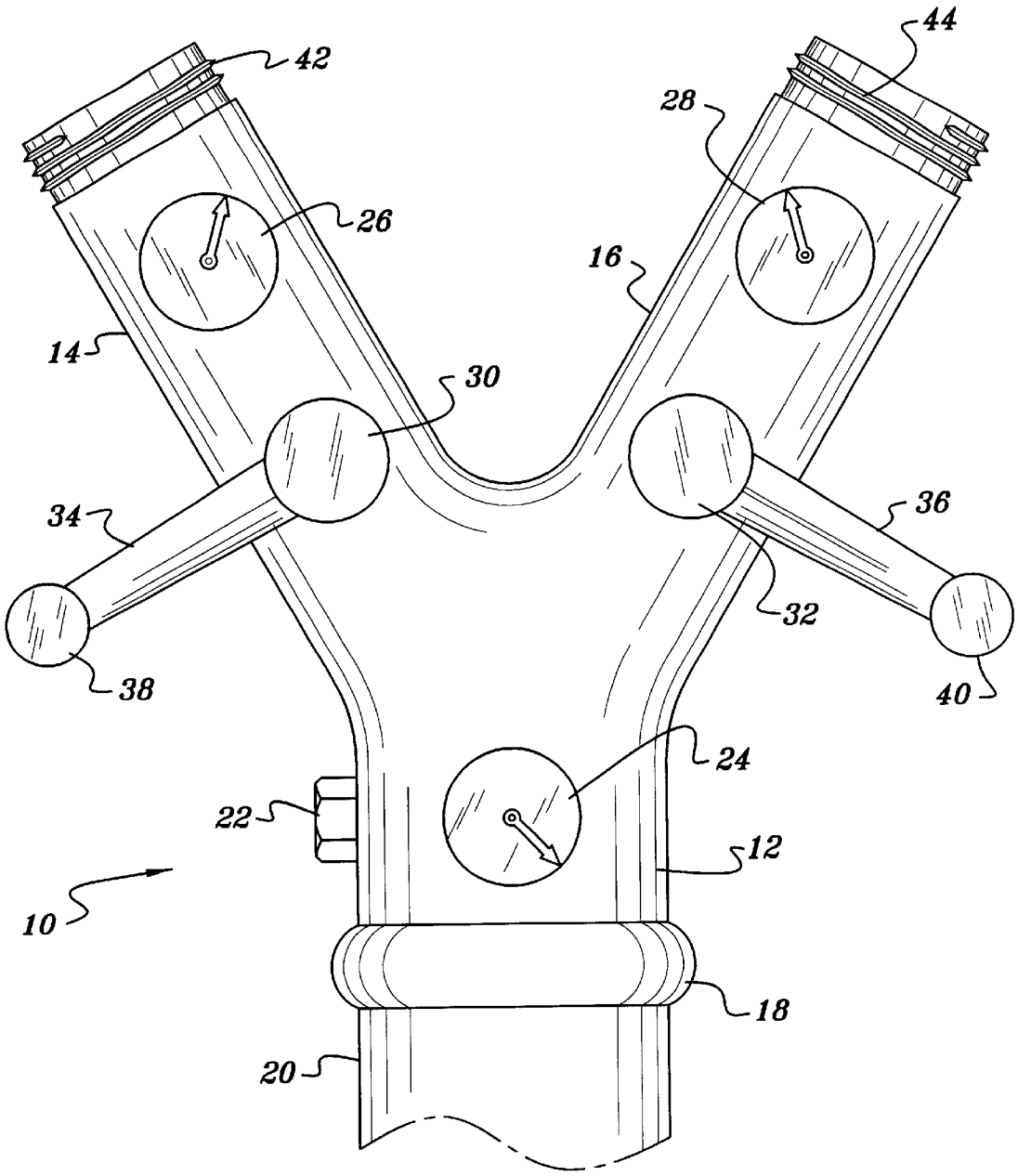
FIG. 1 is a plan view of the apparatus of the present invention.

Referring to FIG. 1, apparatus 10 of the present invention comprises an fluid inlet portion 12 and fluid outlet portions 14 and 16 extending from and fluidly connected to the fluid inlet portion 12. As shown in FIG. 1, fluid inlet portion 12 and fluid outlet portions 14 and 16 are arranged in a substantially Y-shaped configuration. However, it is to be understood that fluid inlet portion 12 and fluid outlet portions 14 and 16 may be arranged in other shapes as well. Preferably, fluid inlet portion 12 and fluid outlet portions 14 and 16 have substantially circular cross-sections.

The inner diameters of the fluid inlet portion 12 and fluid outlet portions 14 and 16 may vary with fluid volume and flow requirements and/or local ordinances. As an example, in one embodiment, the inner diameter of fluid inlet portion 12 is about 2.5 inches and the inner diameter of each of the fluid outlet portions 14 and 16 is about 1.5 inches.

The fluid inlet portion 12 is adapted for fluid connection to a nipple of standpipe 20 typically found in public, industrial or commercial buildings or on fire fighting vehicles that contain fluid supply tanks. In one embodiment, as shown in the figure, a swivel collar 18 and accompanying lugs (not shown) are used to fluidly connect fluid inlet portion 12 to the nipple of the standpipe 20. The fluid inlet portion 12 has female threading (hidden) for connection to the standpipe 20.

The fluid inlet portion 12 includes a device for controlling the flow and measuring the pressure of fluid from inlet portion 12. In one embodiment, and as shown in the figure, the aforementioned device comprises regulator 22. In one embodiment, regulator 22 is configured as a conventional ball valve with a spring biased stem (not shown). Such a configuration is disclosed in Thieme U.S. Pat. No. 3,028,877, the disclosure of which is incorporated herein by reference. In such a configuration, a control key is located on the exterior of the fluid inlet portion 12. The control key is configured to be manipulated by hand or a tool so as to enable rotation of the control key. For example, in one embodiment, the control key has a polygonal head that can be manipulated by a spanner wrench. Adjustment or rotation of the control key controls or regulates the amount of fluid flowing through fluid inlet portion 12. For example, rotating the control key in one direction will decrease the flow of fluid flowing through the fluid inlet portion 12 and rotating the control key in an opposite direction will increase the flow of fluid flowing through the fluid inlet portion 12. The aforementioned configuration has been described as one example for controlling the flow and measuring the pressure of fluid flowing through fluid inlet portion 12. However, it is to be understood that other flow control configurations can be used as well. The fluid inlet portion 12 also includes a fluid pressure meter 24 that is partially embedded in the surface of the fluid inlet portion 12 for measuring the pressure of the fluid flowing therethrough.

The fluid outlet portion 14 includes a device for controlling the flow and measuring the pressure of fluid flowing therethrough. Specifically, and as shown in the figure, fluid outlet portion 14 includes a fluid flow regulator 30 for controlling the flow of fluid through fluid outlet portion 14. In one embodiment, regulator 30 is configured as a conventional cock. Such a cock configuration is disclosed in Morris U.S. Pat. No. 1,099,713, the disclosure of which is incorporated herein by reference. Handle 34 is attached to the portion of the regulator 30 that is located on the exterior of the fluid outlet portion 14. Thus, adjustment or rotation of the handle 34 causes a change in the flow of fluid through fluid outlet portion 14. The handle 34 has knob 38 to facilitate adjustment by users with gloved hands. The fluid outlet portion 14 has male threading 42 for fluid connection to water hoses or other fluid conduits. The aforementioned configuration has been described as one example for controlling the flow of fluid flowing through fluid outlet portion 14. However, it is to be understood that other flow control configurations can be used as well.

The fluid outlet portion 16 includes a device for controlling the flow and measuring the pressure of fluid flowing therethrough. Specifically, and as shown in FIG. 1, the fluid outlet portion 16 has a fluid flow regulator 32 for controlling the flow of fluid through fluid outlet portion 16. In one embodiment, regulator 32 is configured as a conventional cock. Such a cock configuration is disclosed in the aforementioned Morris U.S. Pat. No. 1,099,713. Handle 36 is attached to the portion of the regulator 32 that is located on the exterior of the fluid outlet portion 16. Thus, adjustment or rotation of the handle 36 causes a change in the flow of fluid through fluid outlet portion 16. The handle 36 has knob 40 to facilitate adjustment by users with gloved hands. The fluid outlet portion 16 has male threading 44 for fluid connection to water hoses or other fluid conduits. The aforementioned configuration has been described as one example for controlling the flow of fluid flowing through fluid outlet portion 16. However, it is to be understood that other flow control configurations can be used as well.

The fluid outlet portions 14, 16 also include fluid pressure meters 26 and 28, respectively, partially embedded in the fluid outlet portions 14 and 16, respectively. Fluid pressure meters 26 and 28 measure the pressure of fluid flowing through fluid outlet portions 14 and 16, respectively.

The ability to control the flow and measure the pressure of fluid flowing through fluid inlet portion 12 and fluid outlet portions 14 and 16 allows for the maintenance of water pressure at each water source at any predetermined pressure. Thus, apparatus 10 of the present invention allows for accurate control of water pressure at each water source. Furthermore, the portability of apparatus 10 and the built-in fluid pressure meters in fluid inlet portions 12 and fluid outlet portions 14 and 16 allow nozzle men, engineers, attack crewmen and other fire fighting personnel arriving on a burning floor to determine the available fluid pressure at any water source.

In a preferred embodiment, apparatus 10 is composed of compositions and materials that are corrosion-resistant and that can withstand relatively high fluid pressures. For example, apparatus 10 may be fabricated from a Pyrolite™ aluminum alloy, copper, brass, stainless steel, plastics, composite materials, etc.

The present invention may be for configured for use with any one of a variety of available fluid sources. For example, the apparatus of the present invention may configured to have more than one fluid inlet portion and only one fluid outlet portion. In such a configuration, each fluid inlet portion is configured substantially similar to fluid inlet portion 12. In another example, the apparatus of the present invention may be configured to have more than two fluid outlet portions wherein each fluid outlet portion is configured substantially similar to fluid outlet portions 14 and 16. Each of the fluid outlet portions may be configured to have a different inner diameter. Thus, the aforementioned alternate configurations may be used as a water thief and forestry water thief systems providing any number of fluid inlet portions and fluid outlet portions of varying sizes.

Apparatus 10 of the present invention may also be used with fluids other than water. For example, apparatus 10 may be used to control the flow and measure the pressure of liquid chemicals, petroleum, fuel and other liquid compositions. It is to be understood that the materials from which apparatus 10 is fabricated are preferably be suited for the specific fluids with which apparatus 10 is used.

Figure 2:
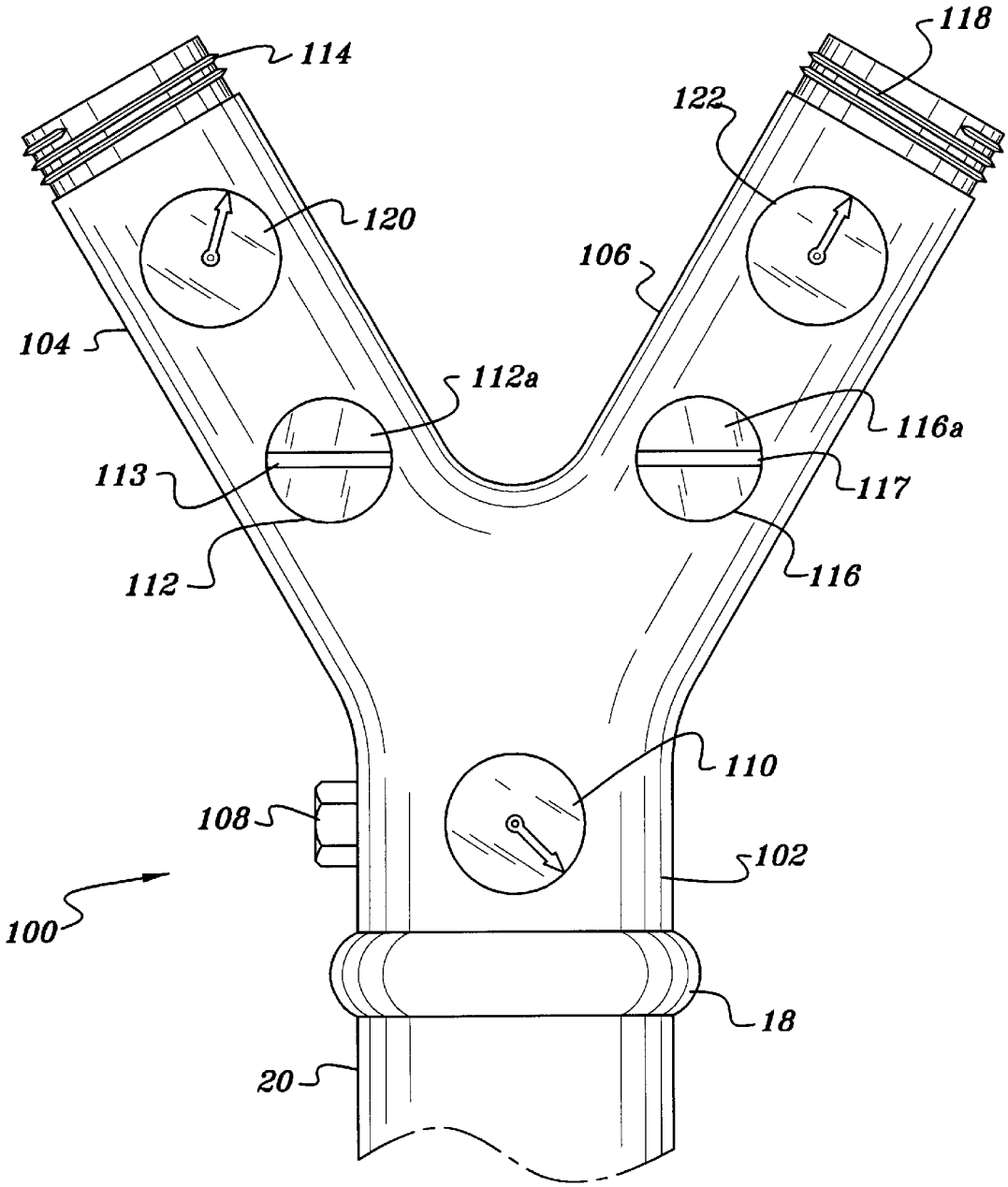
FIG. 2 is a plan view of an alternate embodiment of the apparatus of the present invention.

Referring to FIG. 2, there is shown an alternate embodiment of apparatus 10 of the present invention. Alternate apparatus 100 of the present invention comprises a fluid inlet portion 102 and fluid outlet portions 104 and 106 extending from and fluidly connected to the fluid inlet portion 102. In one embodiment, fluid inlet portion 102 and fluid outlet portions 104 and 106 are arranged in a substantially Y-shaped configuration. However, it is to be understood that fluid inlet portion 102 and fluid outlet portions 104 and 106 can be arranged in other configurations. Preferably, fluid inlet portion 102 and fluid outlet portions 104 and 106 have substantially circular cross-sections.

As described above for apparatus 10, the inner diameters of the fluid inlet portion 102 and fluid outlet portions 104 and 106 may vary with fluid volume and flow requirements and/or local ordinances.

The fluid inlet portion 102 is adapted for fluid connection to a nipple of standpipe 20 typically found in public, industrial or commercial buildings or on fire fighting vehicles that contain fluid supply tanks. In one embodiment, as shown in FIG. 2, a swivel collar 18 and accompanying lugs (not shown) are used to fluidly connect fluid inlet portion 102 to the nipple of the standpipe 20. The fluid inlet portion 102 has female threading (hidden) for connection to the standpipe 20.

The fluid inlet portion 102 includes a device for controlling the flow and measuring the pressure of fluid from inlet portion 102. In one embodiment, and as shown in FIG. 2, the aforementioned device comprises regulator 108. In one embodiment, regulator 108 is configured as a conventional ball valve with a spring biased stem (not shown). Such a configuration is disclosed in Thieme U.S. Pat. No. 3,028,877. In such a configuration, a control key is located on the exterior of the fluid inlet portion 102. The control key is configured to be manipulated by hand or a tool so as to enable rotation of the control key. For example, in one embodiment, the control key has a polygonal head that can be manipulated by a spanner wrench. Adjustment or rotation of the control key controls or regulates the amount of fluid flowing through fluid inlet portion 102. For example, rotating the control key in one direction will decrease the flow of fluid flowing through the fluid inlet portion 102 and rotating the control key in an opposite direction will increase the flow of fluid flowing through the fluid inlet portion 102. The fluid inlet portion 102 also includes a fluid pressure meter 110 that is partially embedded in the surface of the fluid inlet portion 102 for measuring the pressure of the fluid flowing therethrough.

The fluid outlet portion 104 includes a device for controlling the flow and measuring the pressure of fluid flowing therethrough. Specifically, and as shown in the figure, fluid outlet portion 104 includes a fluid flow regulator 112 for controlling the flow of fluid through fluid outlet portion 104. In one embodiment, regulator 112 is configured as the same type of regulator as regulator 108. Regulator 112 includes a rotatable control key 112*a* that is located on the exterior of the fluid inlet portion 104. In one embodiment, control key 112*a* is substantially embedded in the surface of fluid outlet portion 104. In such an embodiment, no portion of key 112*a* extends or protrudes beyond the exterior surface of fluid outlet portion 104. Adjustment or rotation of control key 112*a* causes a change in the flow of fluid through fluid outlet portion 104. In one embodiment, control key 112*a* has a recess or channel 113 for receiving a portion of a hand tool so as to enable rotation of the control key. In another embodiment, control key 112*a* is configured to be manipulated by hand or a tool (e.g. spanner wrench) so as to enable rotation of the control key. The fluid outlet portion 104 has male threading 114 for fluid connection to water hoses or other fluid conduits. The aforementioned configuration has been described as one example for controlling the flow of fluid flowing through fluid outlet portion 104. However, it is to be understood that other flow control configurations can be used as well.

The fluid outlet portion 106 includes a device for controlling the flow and measuring the pressure of fluid flowing therethrough. Specifically, and as shown in FIG. 2, fluid outlet portion 106 includes a fluid flow regulator 116 for controlling the flow of fluid through fluid outlet portion 106. In one embodiment, regulator 116 is configured as the same type of regulator as regulator 108. Regulator 116 includes rotatable control key 116*a* that is located on the exterior of the fluid inlet portion 106. In one embodiment, control key 116*a* is substantially embedded in the surface of fluid outlet portion 106. In such an embodiment, no portion of key 116*a* extends or protrudes beyond the exterior surface of fluid outlet portion 106. Adjustment or rotation of control key 116*a* causes a change in the flow of fluid through fluid outlet portion 106. In one embodiment, control key 116*a* has a recess or channel 117 for receiving a portion of a hand tool so as to enable rotation of control key 116*a*. In another embodiment, control key 116*a* is configured to be manipulated by hand or a tool (e.g. spanner wrench) so as to enable rotation of the control key. The fluid outlet portion 106 has male threading 118 for fluid connection to water hoses or other fluid conduits.

The fluid outlet portions 104 and 106 also include fluid pressure meters 120 and 122, respectively. Fluid pressure meters 120 and 122 are partially embedded in the surfaces of fluid outlet portions 104 and 106, respectively. Fluid pressure meters 120 and 122 measure the pressure of fluid flowing through fluid outlet portions 104 and 106, respectively.

Figure 3:
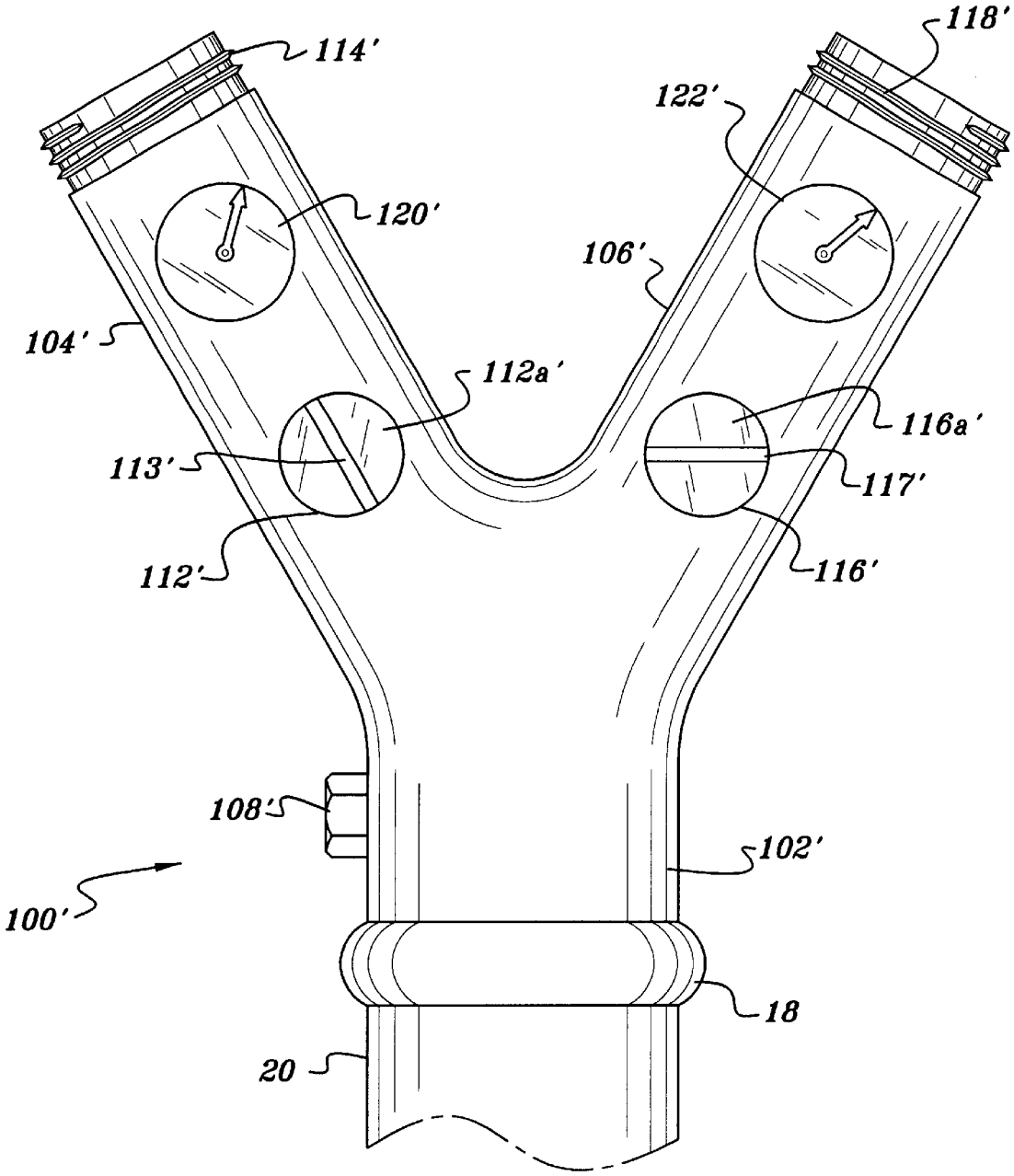
FIG. 3 is a plan view of a further embodiment of the apparatus of the present invention.

Referring to FIG. 3, there is shown a further embodiment of the apparatus of the present invention. Apparatus 100' comprises fluid inlet portion 102' and fluid outlet portions 104' and 106'. Apparatus 100' is generally the same as apparatus 100 of FIG. 2 except that fluid inlet portion 102' does not include a fluid pressure meter. The fluid inlet portion 102' is adapted for fluid connection to a nipple of standpipe 20 typically found in public, industrial or commercial buildings or on fire fighting vehicles that contain fluid supply tanks. In one embodiment, as shown in FIG. 3, a swivel collar 18 and accompanying lugs (not shown) are used to fluidly connect fluid inlet portion 102' to the nipple of the standpipe 20. The fluid inlet portion 102' has female threading (hidden) for connection to the standpipe 20.

The fluid inlet portion 102' includes a device for controlling the flow of fluid from inlet portion 102'. In one embodiment, and as shown in FIG. 3, the aforementioned device comprises regulator 108'. In one embodiment, regulator 108' is configured as a conventional ball valve with a spring biased stem (not shown). Such a configuration is disclosed in Thieme U.S. Pat. No. 3,028,877. Regulator 108' includes a rotatable control key that is located on the exterior of the fluid inlet portion 102'. Adjustment or rotation of the control key controls or regulates the amount of fluid flowing through fluid inlet portion 102'. For example, rotating the control key in one direction will decrease the flow of fluid flowing through the fluid inlet portion 102' and rotating the control key in an opposite direction will increase the flow of fluid flowing through the fluid inlet portion 102' The control key is configured to be manipulated by hand or a tool so as to enable rotation of the control key. For example, in one embodiment, the control key has a polygonal head that can be manipulated by a spanner wrench.

The fluid outlet portion 104' includes a device for controlling the flow and measuring the pressure of fluid flowing therethrough. Specifically, and as shown in the figure, fluid outlet portion 104' includes a fluid flow regulator 112' for controlling the flow of fluid through fluid outlet portion 104'. In one embodiment, regulator 112' is configured as the same type of regulator as regulator 108 (see FIG. 2). Regulator 112' includes rotatable control key 112*a*' that is located on the exterior of fluid outlet portion 104'. In one embodiment, control key 112*a*' is substantially embedded in the surface of fluid outlet portion 104'. In such an embodiment, no portion of key 112*a*' extends or protrudes beyond the exterior surface of fluid outlet portion 104'. Adjustment or rotation of control key 112*a*' causes a change in the flow of fluid through fluid outlet portion 104'. In one embodiment, control key 112*a*' has a recess or channel 113' for receiving a portion of the hand tool so as to enable rotation of the control key 112*a*'. In another embodiment. control key 112*a*' is configured to be manipulated by hand or a tool (e.g. spanner wrench) so as to enable rotation of the control key. The fluid outlet portion 104' has male threading 114' for fluid connection to water hoses or other fluid conduits.

The fluid outlet portion 106' includes a device for controlling the flow and measuring the pressure of fluid flowing therethrough. Specifically, and as shown in FIG. 3, fluid outlet portion 106' includes a fluid flow regulator 116' for controlling the flow of fluid through fluid outlet portion 106'. In one embodiment, regulator 116' is configured as the same type of regulator as regulator 108. Regulator 116' includes rotatable control key 116*a*' that is located on the exterior of the fluid outlet portion 106'. In one embodiment, control key 116*a*' is substantially embedded in the surface of fluid outlet portion 106'. In such an embodiment, no portion of control key 116*a*' extends or protrudes beyond the exterior surface of fluid outlet portion 106'. Adjustment or rotation of control key 116*a*' causes a change in the flow of fluid through fluid outlet portion 106'. In one embodiment, control key 116*a*' has a recess or channel 117' for receiving a portion of a hand tool so as to enable rotation of control key 116*a*'. In another embodiment, control key 116*a*' is configured to be manipulated by hand or a tool (e.g. spanner wrench) so as to enable rotation of the control key. The fluid outlet portion 106' has male threading 118' for fluid connection to water hoses or other fluid conduits. The aforementioned configuration has been described as one example for controlling the flow of fluid flowing through fluid outlet portion 106'.

The fluid outlet portions 104', 106' also include fluid pressure meters 120' and 122', respectively. Fluid pressure meters 120' and 122' are partially embedded in the fluid outlet portions 104' and 106', respectively. Fluid pressure meters 120' and 122' measure the pressure of fluid flowing through fluid outlet portions 104' and 106', respectively.

Figure 4:
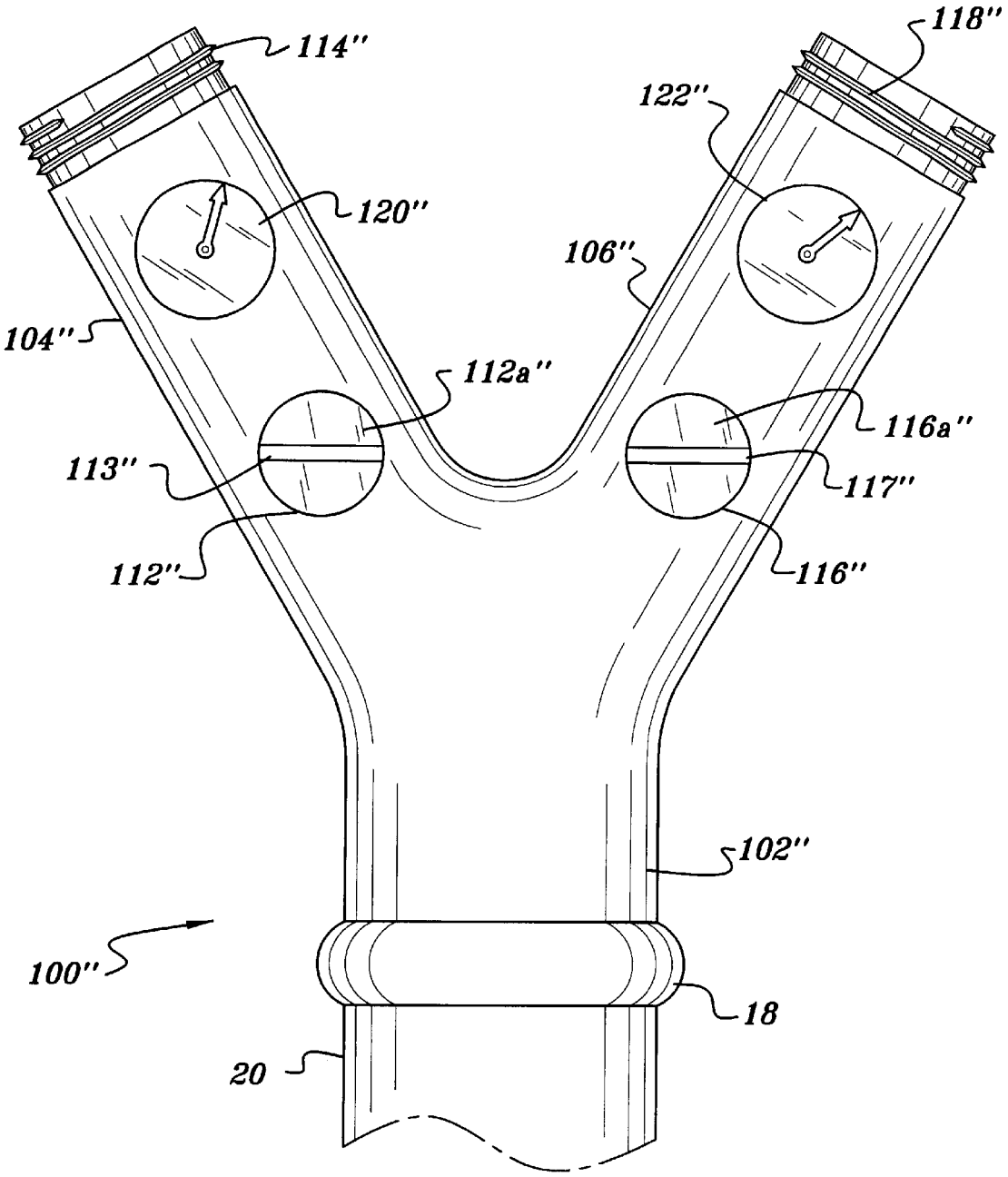
FIG. 4 is a plan view of a yet another embodiment of the apparatus of the present invention.

Referring to FIG. 4, there is shown alternate embodiment 100" of the present invention. Apparatus 100" comprises fluid inlet portion 102" and fluid outlet portions 104" and 106". Apparatus 100" is generally the same as apparatus 100' of FIG. 3 except that fluid inlet portion 102" does not include a fluid regulator 108'. The fluid inlet portion 102" is adapted for fluid connection to a nipple of standpipe 20 typically found in public, industrial or commercial buildings or on fire fighting vehicles that contain fluid supply tanks. In one embodiment, as shown in the figure, a swivel collar 18 and accompanying lugs (not shown) are used to fluidly connect fluid inlet portion 102" to the nipple of the standpipe 20. The fluid inlet portion 102" has female threading (hidden) for connection to the standpipe 20.

The fluid outlet portion 104" includes a device for controlling the flow and measuring the pressure of fluid flowing therethrough. Specifically, and as shown in FIG. 4, fluid outlet portion 104" includes a fluid flow regulator 112" for controlling the flow of fluid through fluid outlet portion 104". In one embodiment, regulator 112" is configured as the same type of regulator as regulator 108 (see FIG. 2). Regulator 112" includes rotatable control key 112*a*" that is located on the exterior of the fluid outlet portion 104". In one embodiment, control key 112*a*" is substantially embedded in the surface of fluid outlet portion 104". In such an embodiment, no portion of control key 112*a*' extends or protrudes beyond the exterior surface of fluid outlet portion 104". Adjustment or rotation of control key 112*a*" causes a change in the flow of fluid through fluid outlet portion 104". In one embodiment, control key 112*a*" has a recess or channel 113" for receiving a portion of a hand tool so as to enable rotation of control key 112*a*". In another embodiment, control key 112*a*" is configured to be manipulated by hand or a tool (e.g. spanner wrench) so as to enable rotation of control key 112*a*". The fluid outlet portion 104" has male threading 114" for fluid connection to water hoses or other fluid conduits. The aforementioned configuration has been described as one example for controlling the flow of fluid flowing through fluid outlet portion 104".

The fluid outlet portion 106" includes a device for controlling the flow and measuring the pressure of fluid flowing therethrough. Specifically, and as shown in FIG. 4, fluid outlet portion 106" includes a fluid flow regulator 116" for controlling the flow of fluid through fluid outlet portion 106". In one embodiment, regulator 116" is configured as the same type of regulator as regulator 108 (see FIG. 2). Regulator 116" includes rotatable control key 116*a*' that is located on the exterior of the fluid outlet portion 106". In one embodiment, control key 116*a*" is substantially embedded in fluid outlet portion 106". In such an embodiment, no portion of control key 116*a*" extends or protrudes beyond the exterior surface of fluid outlet portion 106". Adjustment or rotation of control key 116*a*" causes a change in the flow of fluid through fluid outlet portion 106". In one embodiment, control key 116*a*" has a recess or channel 117" for receiving a portion of a hand tool so as to enable rotation of control key 116*a*". In another embodiment, control key 116*a*" is configured to be manipulated by hand or a tool (e.g. spanner wrench) so as to enable rotation of the control key. The fluid outlet portion 106" has male threading 118" for fluid connection to water hoses or other fluid conduits.

The fluid outlet portions 104", 106" also include fluid pressure meters 120" and 122", respectively. Fluid pressure meters 120" and 122" are partially embedded in fluid outlet portions 104" and 106", respectively. Fluid pressure meters 120" and 122" measure the pressure of fluid flowing through fluid outlet portions 104" and 106", respectively.

Figure 5:
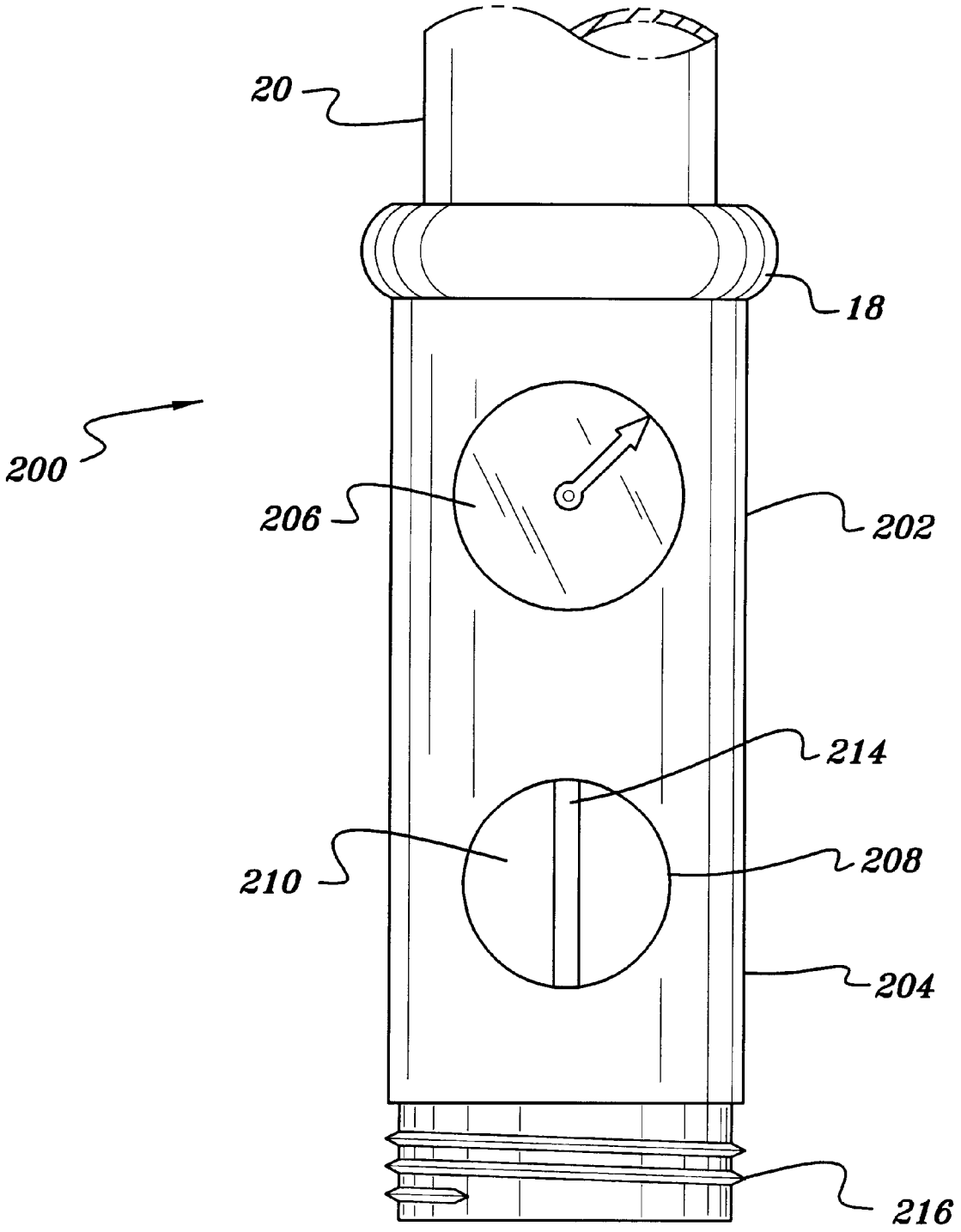
FIG. 5 is a plan view of a further embodiment of the apparatus of the present invention.

Referring to FIG. 5, there is shown a further embodiment 200 of the present invention. Apparatus 200 of the present invention comprises an fluid inlet portion 202 and fluid outlet portion 204 fluidly connected to the fluid inlet portion 202. Preferably, fluid inlet portion 202 and fluid outlet portion 204 have substantially circular cross-sections.

The fluid inlet portion 202 is adapted for fluid connection to a nipple of standpipe 20 typically found in public, industrial or commercial buildings or on fire fighting vehicles that contain fluid supply tanks. In one embodiment, as shown in FIG. 5, a swivel collar 18 and accompanying lugs (not shown) are used to fluidly connect fluid inlet portion 202 to the nipple of the standpipe 20. The fluid inlet portion 202 has female threading (hidden) for connection to the standpipe 20.

Apparatus 200 includes fluid pressure meter 206 that is partially embedded in the surface of the fluid inlet portion 202 for measuring the pressure of the fluid flowing therethrough. Apparatus 200 further includes regulator 208 for controlling the flow of fluid therethrough. In one embodiment, regulator 208 is configured as the same type of regulator as regulator 108 (see FIG. 2). Regulator 208 includes rotatable control key 210 located on the exterior of the fluid outlet portion 204. In one embodiment, control key 210 is substantially embedded in fluid outlet portion 204. In such an embodiment, no portion of control key 210 extends or protrudes beyond the exterior surface of fluid outlet portion 204. Adjustment or rotation of control key 210 controls or regulates the amount of fluid flowing through fluid inlet portion 202. For example, rotating control key 210 in one direction will decrease the flow of fluid flowing through the fluid inlet portion 202 and rotating control key 210 in an opposite direction will increase the flow of fluid flowing through the fluid inlet portion 202. In one embodiment, control key 210 includes recess or channel 214 for receiving a portion of a hand tool so as to enable rotation of control key 210. In another embodiment, control key 210 is configured to have a polygonal head that can be manipulated by a spanner wrench. The fluid outlet portion 204 has male threading 216 for fluid connection to water hoses or other fluid conduits.

In an alternate embodiment, a swivel collar 18 and accompanying lugs (not shown) are used to fluidly connect portion 204 to the nipple of the standpipe 20. In such a configuration, fluid inlet portion 204 has female threading or a female coupling (hidden) for connection to the standpipe 20, and fluid outlet portion 202 has male threading (similar to threading 216) for fluid connection to water hoses or other fluid conduits.

In all the embodiments described above, the hand tools, e.g. spanner wrench, etc. may be movably attached to each apparatus to avoid fire-fighting personnel having to search for the necessary hand tools. In one configuration, the hand tool would be attached to one end of a flexible member, e.g. wire, strap, etc. and the other end of the flexible member would be attached to apparatus 10, 100, 100', 100" and 200. Fasteners may be used to removably secure the hand tool to the exterior of the aforementioned apparatuses in order to prevent the hand tool from moving or dangling or hanging from the flexible member.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for controlling the pressure of fluids comprising:

a single fluid inlet portion adapted for fluid connection to a fluid source, the single fluid inlet portion having a diameter;

a pair of fluid outlet portions fluidly connected to the fluid inlet portion, each of the fluid outlet portions having a diameter;

said fluid inlet portion and said pair of fluid outlet portions being arranged in a substantially "Y" shaped configuration;

a first movable fluid flow regulator member located within the fluid inlet portion for regulating the flow of fluid therethrough wherein the flow of fluids through the fluid inlet portion is affected by the position of the movable fluid flow regulator member;

a first adjustable member on the fluid inlet portion, the adjustable member having a first portion accessible from the exterior of the fluid inlet portion and a second portion located within the fluid inlet portion for positioning the movable regulator member so as to achieve a desired fluid flow, the first portion of the first adjustable member being partially embedded in the surface of the fluid inlet portion, the first portion of the first adjustable member having a recess for receiving a portion of a tool, the first portion of the first adjustable member having a size that does not extend beyond the diameter of the fluid inlet portion;

a first fluid pressure meter for indicating the pressure of the fluid flowing through the fluid inlet portion, the first fluid pressure meter being partially embedded in the surface of the fluid inlet portion;

a second movable fluid flow regulator member located within the of the fluid outlet portions for regulating the flow of fluid therethrough wherein the flow of fluids through the one of the fluid outlet portions is affected by the position of the second movable fluid flow regulator member;

a second adjustable member on the one of the fluid outlet portions, the second adjustable member having a first portion accessible from the exterior of the one of the fluid outlet portions and a second portion located within the one of the fluid outlet portions for positioning the second movable fluid flow regulator member so as to achieve a desired fluid flow, the first portion of the second adjustable member being at least partially embedded in the surface of the one of the fluid outlet portions, the first portion of the second adjustable member having a recess for receiving a portion of a tool, the first portion of the second adjustable member having a size that does not extend beyond the diameter of the one of the fluid outlet portions;

a second fluid pressure meter for indicating the pressure of the fluid flowing through the one of the fluid outlet portions, the second fluid pressure meter being partially embedded in the surface of the one of the fluid outlet portions;

a third movable fluid flow regulator member located within the other fluid outlet portion for regulating the flow of fluid therethrough wherein the flow of fluids through the other fluid outlet portion is affected by the position of the third movable fluid flow regulator member;

a third adjustable member on the other fluid outlet portion, the third adjustable member having a first portion accessible from the exterior of the other fluid outlet portion and a second portion located within the other fluid outlet portion for positioning the third movable fluid flow regulator member so as to achieve a desired fluid flow, the first portion of the third adjustable member being partially embedded in the surface of the other fluid outlet portion, the first portion of the third adjustable member having a recess for receiving a portion of a tool, the first portion of the third adjustable member having a size that does not extend beyond the diameter of the other fluid outlet portion; and a third fluid pressure meter for indicating the pressure of the fluid flowing through the other fluid outlet portion, the third fluid pressure meter being partially embedded in the surface of the other fluid outlet portion.

2. An apparatus for controlling the pressure of fluids comprising:

a single fluid inlet portion adapted for fluid connection to a fluid source, the single fluid inlet portion having a diameter;

a pair of fluid outlet portions fluidly connected to the fluid inlet portion, each of the fluid outlet portions having a diameter;

said fluid inlet portion and said pair of fluid outlet portions being arranged in a substantially "Y" shaped configuration;

a first movable fluid flow regulator member located within the fluid inlet portion for regulating the flow of fluid therethrough wherein the flow of fluids through the fluid inlet portion is affected by the position of the movable fluid flow regulator member;

a first adjustable member on the fluid inlet portion, the first adjustable member having a first portion accessible from the exterior of the fluid inlet portion and a second portion located within the fluid inlet portion for positioning the movable regulator member so as to achieve a desired fluid flow, the first portion of the first adjustable member being partially embedded in the surface of the fluid inlet portion, the first portion of the first adjustable member having a recess for receiving a portion of a tool, the first portion of the first adjustable member having a size that does not extend beyond the diameter of the fluid inlet portion;

the first fluid inlet portion being configured without a device for measuring the pressure of the fluid flowing therethrough;

a second movable fluid flow regulator member located within one of the fluid outlet portions for regulating the flow of fluid therethrough wherein the flow of fluids through the one of the fluid outlet portions is affected by the position of the second movable fluid flow regulator member;

a second adjustable member on the one of the fluid outlet portions, the second adjustable member having a first portion accessible from the exterior of the one of the fluid outlet portions and a second portion located within the one of the fluid outlet portions for positioning the second movable fluid flow regulator member so as to achieve a desired fluid flow, the first portion of the second adjustable member being at least partially embedded in the surface of the one of the fluid outlet portions, the first portion of the second adjustable member having a recess for receiving a portion of a tool, the first portion of the second adjustable member having a size that does not extend beyond the diameter of the one of the fluid outlet portions;

a first fluid pressure meter for indicating the pressure of the fluid flowing through the one of the fluid outlet portions, the first fluid pressure meter being partially embedded in the surface of the one of the fluid outlet portion;

a third movable fluid flow regulator member located within the other fluid outlet portion for regulating the flow of fluid therethrough wherein the flow of fluids through the other fluid outlet portion is affected by the position of the third movable fluid flow regulator member;

a third adjustable member on the other fluid outlet portion, the third adjustable member having a first portion accessible from the exterior of the other fluid outlet portion and a second portion located within the other fluid outlet portion for positioning the third movable fluid flow regulator member so as to achieve a desired fluid flow, the first portion of the third adjustable member being partially embedded in the surface of the other fluid outlet portion, the first portion of the third adjustable member having a recess for receiving a portion of a tool, the first portion of the third adjustable member having a size that does not extend beyond the diameter of the other fluid outlet portion; and a second fluid pressure meter for indicating the pressure of the fluid flowing through the other fluid outlet portion, the second fluid pressure meter being partially embedded in the surface of the other fluid outlet portion.

3. An apparatus for controlling the pressure of fluids comprising:

a single fluid inlet portion adapted for fluid connection to a fluid source, the single fluid inlet portion having a diameter, the fluid inlet portion being configured without a device to control the flow and measure the pressure of fluids flowing therethrough;

a pair of fluid outlet portions fluidly connected to the fluid inlet portion, each of the fluid outlet portions having a diameter;

said fluid inlet portion and said pair of fluid outlet portions being arranged in a substantially "Y" shaped configuration;

a first movable fluid flow regulator member located within one of the fluid outlet portions for regulating the flow of fluid therethrough wherein the flow of fluids through the one of the fluid outlet portions is affected by the position of the first movable fluid flow regulator member;

a first adjustable member on the one of the fluid outlet portions, the first adjustable member having a first portion accessible from the exterior of the one of the fluid outlet portions and a second portion located within the one of the fluid outlet portions for positioning the first movable fluid flow regulator member so as to achieve a desired fluid flow, the first portion of the first adjustable member being at least partially embedded in the surface of the one of the fluid outlet portions, the first portion of the first adjustable member having a recess for receiving a portion of a tool, the first portion of the first adjustable member having a size that does not extend beyond the diameter of the one of the fluid outlet portions;

a first fluid pressure meter for indicating the pressure of the fluid flowing through the one of the fluid outlet portions, the first fluid pressure meter being partially embedded in the surface of the one of the fluid outlet portions;

a second movable fluid flow regulator member located within the other fluid outlet portion for regulating the flow of fluid therethrough wherein the flow of fluids through the other fluid outlet portion is affected by the position of the second movable fluid flow regulator member;

a second adjustable member on the other fluid outlet portion, the second adjustable member having a first portion accessible from the exterior of the other fluid outlet portion and a second portion located within the other fluid outlet portion for positioning the second movable fluid flow regulator member so as to achieve a desired fluid flow, the first portion of the second adjustable member being partially embedded in the surface of the other fluid outlet portion, the first portion of the second adjustable member having a recess for receiving a portion of a tool, the first portion of the second adjustable member having a size that does not extend beyond the diameter of the other fluid outlet portion; and a second fluid pressure meter for indicating the pressure of the fluid flowing through the other fluid outlet portion, the second fluid pressure meter being partially embedded in the surface of the other fluid outlet portion.

4. An apparatus for controlling the flow and measuring the pressure of fluids comprising a generally tubular member having a single fluid inlet portion adapted for fluid connection to a fluid source, a single fluid outlet portion fluidly connected to the fluid inlet portion, and a fluid pressure meter for indicating the pressure of fluid flowing through the tubular member, the fluid pressure meter being partially embedded in the surface of the tubular member, the apparatus further including a movable fluid flow regulator member located within the tubular member for regulating the flow of fluid therethrough wherein the flow of fluids through the tubular member is affected by the position of the movable fluid regulator member and an adjustable member on the tubular member, the adjustable member having a first portion accessible from the exterior of the tubular member and a second portion located within the tubular member for positioning the movable regulator member so as to achieve a desired fluid flow through the tubular member.

5. The apparatus according to claim 4 wherein the first portion of the adjustable member is at least partially embedded in the surface of the tubular member.

6. The apparatus according to claim 5 wherein the first portion of the adjustable member has a recess for receiving a portion of a tool.

7. The apparatus according to claim 4 wherein the tubular member has a diameter and the first portion of the adjustable member has a size that does not extend beyond the diameter of the tubular member.

* * * * *

UNITED STATES PATENT AND TRADEMARK OFFICE

CERTIFICATE OF CORRECTION

PATENT NO. : 6,321,782 B1
DATED : November 27, 2001
INVENTOR(S) : Hollister

It is certified that error appears in the above-identified patent and that said Letters Patent is hereby corrected as shown below:

Column 10,
Line 61, immediately after “within”, delete “the” and substitute thereor -- one --.

Signed and Sealed this

Thirtieth Day of July, 2002

*Attest:*

*Attesting Officer*

JAMES E. ROGAN
*Director of the United States Patent and Trademark Office*